US011344131B2

(12) United States Patent
Choi

(10) Patent No.: US 11,344,131 B2
(45) Date of Patent: May 31, 2022

(54) CONNECTORS FOR COLLAPSIBLE BED FRAME AND COLLAPSIBLE BED FRAME HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 257 days.

(21) Appl. No.: 16/432,075

(22) Filed: Jun. 5, 2019

(65) Prior Publication Data

US 2019/0387888 A1 Dec. 26, 2019

(30) Foreign Application Priority Data

Jun. 21, 2018 (CN) ..... 201820960122.9

(51) Int. Cl.

| | |
|---|---|
| ***A47C 19/12*** | (2006.01) |
| ***A47C 19/00*** | (2006.01) |
| ***A47C 19/02*** | (2006.01) |

(52) U.S. Cl.

CPC ..... *A47C 19/12* (2013.01); *A47C 19/005* (2013.01); *A47C 19/025* (2013.01)

(58) Field of Classification Search

CPC ..... A47C 19/12; A47C 19/005; A47C 19/025; A47C 19/122; A47C 19/126; A47C 19/027; A47C 19/021; F16B 12/54

See application file for complete search history.

(56) References Cited

U.S. PATENT DOCUMENTS

| | | | |
|---|---|---|---|
| 273,332 | A | 3/1883 | Woodin |
| 277,541 | A | 5/1883 | Bowers |
| 372,913 | A | 11/1887 | Hopkins |
| 557,997 | A | 4/1896 | Nessel |
| 687,238 | A | 11/1901 | Johnson |
| 705,384 | A | 7/1902 | Cooper |
| 736,569 | A | 8/1903 | Webb |
| 746,211 | A | 12/1903 | Webb |
| 797,011 | A | 8/1905 | Mosier |
| 984,823 | A | 2/1911 | Linden |
| 1,072,550 | A | 9/1913 | Wilson |
| 1,694,420 | A | 12/1928 | Joselowitz |
| 1,760,955 | A | 6/1930 | Moss |
| 1,806,358 | A | 5/1931 | Manly |
| 1,833,692 | A | 11/1931 | Silvio |
| 2,057,334 | A | 10/1936 | Hannum |

(Continued)

FOREIGN PATENT DOCUMENTS

| | | | |
|---|---|---|---|
| DE | 102018130110 | A1 | 5/2020 |
| EP | 2182151 | A2 | 5/2010 |

*Primary Examiner* — Robert G Santos
*Assistant Examiner* — Alison N Labarge
(74) *Attorney, Agent, or Firm* — Morgan, Lewis & Bockius LLP

(57) ABSTRACT

Disclosed are connectors and collapsible bed frames. A collapsible bed frame includes lateral and longitudinal bar units. Between each of two adjacent lateral bar units, a first longitudinal bar unit is disposed at a first side of the collapsible bed frame and a second longitudinal bar unit is disposed at a second side of the collapsible bed frame. The first and second longitudinal bar units and the two adjacent lateral bar units are rotatably connected with each other by connectors that enable the collapsible bed frame to contract and expand while the lateral and longitudinal bar units are connected with each other.

19 Claims, 11 Drawing Sheets

(56) References Cited

U.S. PATENT DOCUMENTS 2,492,070 A 12/1949 Stone et al.
2,584,491 A 2/1952 Ted
2,602,012 A 7/1952 Doty
2,680,252 A 6/1954 Hatton
2,772,424 A 12/1956 Roche
2,782,075 A 2/1957 Roscoe
2,823,392 A 2/1958 Howard
2,905,513 A 9/1959 Kane
2,962,085 A 11/1960 Frank
2,983,931 A 5/1961 Nelson
3,185,499 A 5/1965 Reese
3,245,363 A 4/1966 Kanitz
3,296,983 A 1/1967 Brush
3,504,877 A 4/1970 Lyon, Sr.
3,605,142 A 9/1971 Weinhart
3,613,132 A 10/1971 Weinhart
3,657,748 A 4/1972 Weinhart
3,984,884 A 10/1976 Spitz
4,391,008 A * 7/1983 Yamaoka ..... A47C 19/005 5/200.1
4,431,164 A 2/1984 Jungo et al.
4,745,644 A 5/1988 Pottschmidt
4,788,727 A * 12/1988 Liu ..... A47C 19/005 5/174
4,974,526 A 12/1990 Wiygul, Jr.
5,469,589 A 11/1995 Steed
5,562,050 A 10/1996 Colquhoun
5,884,566 A 3/1999 Chen
5,943,968 A 8/1999 Dobson
6,449,786 B1 9/2002 Voit
6,485,219 B1 11/2002 Beyer
7,003,822 B1 2/2006 Sheehy
7,376,986 B2 5/2008 Smith
7,690,316 B2 4/2010 Yoo
7,739,760 B2 * 6/2010 Wang ..... F04D 25/166 5/176.1
7,784,122 B2 8/2010 Oh
RE41,763 E 9/2010 Ng
7,845,030 B1 * 12/2010 Pollard ..... A47C 19/124 5/308
8,006,328 B2 8/2011 Polevoy
8,006,329 B2 8/2011 Oh
8,042,205 B2 10/2011 Schulz, Jr.
8,176,581 B2 5/2012 Schulz, Jr.
8,678,490 B2 3/2014 Chen
8,822,885 B2 9/2014 Daneshvar
8,832,876 B1 9/2014 Oh
8,935,819 B1 1/2015 Hartley
8,978,176 B1 * 3/2015 Oh ..... A47C 19/12 5/400
8,990,979 B1 * 3/2015 Craver ..... A47C 19/021 5/400
9,021,964 B2 5/2015 Peng
9,332,833 B2 5/2016 Kim
9,596,943 B1 3/2017 Hartley
9,924,804 B2 3/2018 Hartley
10,321,767 B2 6/2019 Jin
10,687,630 B1 6/2020 Hartley
10,702,070 B2 7/2020 Oh
10,959,529 B2 3/2021 Choi
10,959,530 B2 3/2021 Choi
10,966,537 B1 4/2021 Denney
2006/0107456 A1 * 5/2006 Joseph ..... A47C 17/58 5/2.1
2008/0109958 A1 5/2008 Wang
2009/0025143 A1 * 1/2009 Oh ..... A47C 19/005 5/201
2010/0170190 A1 7/2010 Schulz, Jr.
2010/0171342 A1 7/2010 Chen
2010/0235989 A1 * 9/2010 Jin ..... A47C 19/126 5/174
2010/0275372 A1 11/2010 Oh
2010/0299831 A1 12/2010 Lee
2011/0258777 A1 10/2011 Schulz, Jr.
2012/0204770 A1 8/2012 Grace
2012/0304380 A1 12/2012 Jin
2013/0000038 A1 1/2013 Schulz, Jr.
2013/0025051 A1 1/2013 Syrowitz
2014/0208506 A1 7/2014 Bartelsmeyer
2016/0143446 A1 * 5/2016 Hartley ..... A47C 23/062 5/236.1
2016/0255963 A1 9/2016 Jones
2016/0296004 A1 10/2016 Peng
2018/0042391 A1 2/2018 Oh
2018/0055235 A1 3/2018 Choi
2018/0116412 A1 5/2018 Jin
2018/0140103 A1 5/2018 Thompson
2019/0387888 A1 12/2019 Choi
2019/0387889 A1 12/2019 Choi
2019/0387890 A1 12/2019 Choi
2019/0387891 A1 12/2019 Choi
2019/0387892 A1 12/2019 Choi
2019/0387893 A1 12/2019 Choi
2020/0022501 A1 1/2020 Choi
2020/0022502 A1 1/2020 Choi
2020/0022503 A1 1/2020 Choi
2020/0146438 A1 5/2020 Choi
2020/0378426 A1 12/2020 Choi

* cited by examiner

CONNECTORS FOR COLLAPSIBLE BED FRAME AND COLLAPSIBLE BED FRAME HAVING SAME

CROSS-REFERENCE TO RELATED APPLICATIONS

The present application claims priority to Chinese Utility Model Application CN 201820960122.9 filed Jun. 21, 2018. The disclosure of the application is incorporated herein for all purposes by reference in its entirety.

FIELD OF THE INVENTION

The present invention generally relates to bed frames and beds, and more particularly, to connectors, collapsible bed frames and beds having collapsible bed frames.

BACKGROUND

Many existing foldable bed frames are not user-friendly. For instance, existing bed frames are usually shipped with most of the components disassembled to save space and reduce cost. To use such a bed frame, one needs to assemble it first. This often involves connecting a number of lateral and longitudinal bars by screws, bolts or other connectors. Conversely, to fold such a bed frame, one needs to remove those connectors and disassemble the lateral and longitudinal bars. Assembling and disassembling the bed frame not only takes time and energy, but also requires tools such as screwdrivers and wrenches available every time when assembling or disassembling is desired. Moreover, disassembled parts, in particular those screws, bolts or other connectors, have to be stored carefully so that they would not get lost. Otherwise, the bed frame may not be assembled properly for next use.

Given the current state of the art, there remains a need for collapsible beds and bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides connectors, collapsible bed frames and beds having such collapsible bed frames.

In various exemplary embodiments, the present invention provides a collapsible bed frame including a plurality of lateral bar units, a plurality of first longitudinal bar units and a plurality of second longitudinal bar units. The lateral bar units are arranged substantially parallel to each other, and each lateral bar has a first end and a second end. The plurality of lateral bar units includes a first outer lateral bar unit, a second outer lateral bar unit, and an inner lateral bar unit disposed between the first and second outer lateral bar units. The plurality of first longitudinal bar units is disposed at a first side of the collapsible bed frame and the plurality of second longitudinal bar units disposed at a second side of the collapsible bed frame. Each longitudinal bar unit in the plurality of first longitudinal bar units and in the plurality of second longitudinal bar units includes a first longitudinal segment unit and a second longitudinal segment unit. The first and second longitudinal segment units are rotatably connected with each other at one ends thereof. The other end of the first longitudinal segment unit is rotatably connected with the first or second end of the inner lateral bar unit. The other end of the second longitudinal segment unit is rotatably connected with the first or second end of the first or second outer lateral bar unit. One or more receptacles are formed or disposed at each bar unit in the plurality of lateral bar units, the plurality of first longitudinal bar units, and the plurality of second longitudinal bar units and configured to removably receive one or more supporting bar units. Each bar unit in the plurality of lateral bar units, the plurality of first longitudinal bar units, and the plurality of second longitudinal bar units includes an upper bar and a lower bar. The upper bars of the plurality of lateral bar units, the plurality of first longitudinal bar units, and the plurality of second longitudinal bar units collectively form an upper frame of the collapsible bed frame. The lower bars of the plurality of lateral bar units, the plurality of first longitudinal bar units, and the plurality of second longitudinal bar units collectively form a lower frame of the collapsible bed frame.

In some exemplary embodiments, the collapsible bed frame further includes a second connector at each of the first and second ends of the inner lateral bar unit. The second connector includes first, second and third pieces. The first piece is formed with a through hole, and fixedly connected with the first or second end of the inner lateral bar unit. The second piece is rotatably connected with the first piece at a first side of the first piece, and fixedly connected with the other end of the first longitudinal segment unit of a longitudinal bar unit in the plurality of first or second longitudinal bar units. The third piece is rotatably connected with the first piece at a second side of the first piece, and fixedly connected with the other end of the first longitudinal segment unit of another longitudinal bar unit in the plurality of first or second longitudinal bar units.

In some exemplary embodiments, the collapsible bed frame further includes a plurality of first connectors. Each first connector includes a first body and a first coupler rotatable with respect to the first body. The first body is connected with the first or second end of a corresponding outer lateral bar unit in the first and second outer lateral bar units. The first coupler is connected with the other end of the second longitudinal segment unit of a corresponding first or second longitudinal bar unit.

In an exemplary embodiment, the first coupler includes a part formed with a second through-hole and configured to couple with the other end of the second longitudinal segment unit of the corresponding first or second longitudinal bar unit.

In some exemplary embodiments, the first and second longitudinal segment units are rotatably connected with each other at the one ends thereof by a substantially U-shaped connector.

In some exemplary embodiments, the collapsible bed frame further includes a plurality of first vertical supporting bars disposed between the upper and lower frames, each having an upper end connected with the upper frame and a lower end connected with the lower frame.

In an exemplary embodiment, the receptacles at the first and second longitudinal bar units are formed or disposed at the upper bars of the first and second longitudinal bar units.

In some exemplary embodiments, the receptacles at the lateral bar units are formed or disposed at the first vertical supporting bars of the lateral bar units.

In an exemplary embodiment, the one or more supporting bar units include one or more longitudinal supporting bar units coupled to the receptacles at the lateral bar units. Each longitudinal supporting bar unit in the one or more longitudinal supporting bar units includes an upper longitudinal supporting bar, a lower longitudinal supporting bar, and one or more second vertical supporting bars disposed between the upper and lower longitudinal supporting bars, each second vertical supporting bar having an upper end connected with the upper longitudinal supporting bar and a lower end connected with the lower longitudinal supporting bar.

In some exemplary embodiments, the collapsible bed frame further includes a plurality of legs coupled with the lower bars of the plurality of lateral bar units.

In various exemplary embodiments, the present invention provides a collapsible bed frame including a plurality of lateral bar units, a plurality of first longitudinal bar units and a plurality of second longitudinal bar units. The lateral bar units are arranged substantially parallel to each other, and each lateral bar has a first end and a second end. The plurality of lateral bar units includes a first outer lateral bar unit, a second outer lateral bar unit, and an inner lateral bar unit disposed between the first and second outer lateral bar units. Between the inner lateral bar and each respective outer lateral bar unit in the first and second outer lateral bar units, a first longitudinal bar unit in the plurality of first longitudinal bar units is disposed at a first side of the collapsible bed frame and a second longitudinal bar unit in the plurality of second longitudinal bar units is disposed at a second side of the collapsible bed frame. Each of the first and second longitudinal bar units includes a first longitudinal segment unit and a second longitudinal segment unit. The first and second longitudinal segment units are rotatably connected with each other at one ends thereof. The other end of the first longitudinal segment unit is rotatably connected with the first or second end of the inner lateral bar unit. The other end of the second longitudinal segment unit is rotatably connected with the first or second end of the respective outer lateral bar unit. The one ends of the first and second longitudinal segment units of the first longitudinal bar unit and the one ends of the first and second longitudinal segment units of the second longitudinal bar unit move toward each other during contraction, and move away from each other during expansion.

In some exemplary embodiments, the collapsible bed frame further includes a plurality of first connectors. Each first connector includes a first body and a first coupler rotatable with respect to the first body. The first body is connected with the first or second end of a corresponding outer lateral bar unit in the first and second outer lateral bar units. The first coupler is connected with the other end of the second longitudinal segment unit of a corresponding first or second longitudinal bar unit.

In some exemplary embodiments, the collapsible bed frame further a second connector at each of the first and second ends of the inner lateral bar unit. The second connector includes first, second and third pieces. The first piece is fixedly connected with the first or second end of the inner lateral bar unit. The second piece is rotatably connected with the first piece at a first side of the first piece, and fixedly connected with the other end of the first longitudinal segment unit of a longitudinal bar unit in the plurality of first or second longitudinal bar units. The third piece is rotatably connected with the first piece at a second side of the first piece, and fixedly connected with the other end of the first longitudinal segment unit of another longitudinal bar unit in the plurality of first or second longitudinal bar units.

In some exemplary embodiments, the collapsible bed frame further includes a plurality of third connectors. Each third connector includes a first coupling piece, a second coupling piece, and a connecting piece having one end connected with the first coupling piece and the other end connected with the second coupling piece. The one end of the first longitudinal segment unit is disposed between the first and second coupling pieces, rotatably connected with the first and second coupling pieces, and rotatable along a first axis. The one end of the second longitudinal segment unit is disposed between the first and second coupling pieces, rotatably connected with the first and second coupling pieces, and rotatable along a second axis.

In various exemplary embodiments, each bar unit in the plurality of lateral bar units, the plurality of first longitudinal bar units, and the plurality of second longitudinal bar units includes an upper bar and a lower bar. The upper bars of the plurality of lateral bar units, the plurality of first longitudinal bar units, and the plurality of second longitudinal bar units collectively form an upper frame of the collapsible bed frame. The lower bars of the plurality of lateral bar units, the plurality of first longitudinal bar units, and the plurality of second longitudinal bar units collectively form a lower frame of the collapsible bed frame.

In some exemplary embodiments, the collapsible bed frame further includes one or more first receptacles formed or disposed at the upper bars of the first and second longitudinal bar units. Each first receptacle is configured to removably receive an end of a lateral supporting bar.

In some exemplary embodiments, the collapsible bed frame further includes a plurality of first vertical supporting bars disposed between the upper and lower frames. Each first vertical supporting bar has an upper end connected with the upper frame and a lower end connected with the lower frame.

In some exemplary embodiments, the collapsible bed frame further includes one or more second receptacles disposed at one or more first vertical supporting bars that are disposed between the upper and lower bars of the lateral bar units. Each second receptacle in the one or more second receptacles is configured to removably receive an end of a longitudinal supporting bar unit.

In an exemplary embodiment, the longitudinal supporting bar unit includes an upper longitudinal supporting bar, a lower longitudinal supporting bar, and one or more second vertical supporting bars disposed between the upper and lower longitudinal supporting bars. Each second vertical supporting bar has an upper end connected with the upper longitudinal supporting bar and a lower end connected with the lower longitudinal supporting bar.

In some exemplary embodiments, the collapsible bed frame further includes a plurality of legs coupled with the lower bars of the plurality of lateral bar units.

The connectors, bed frames and beds of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

Figure 1:
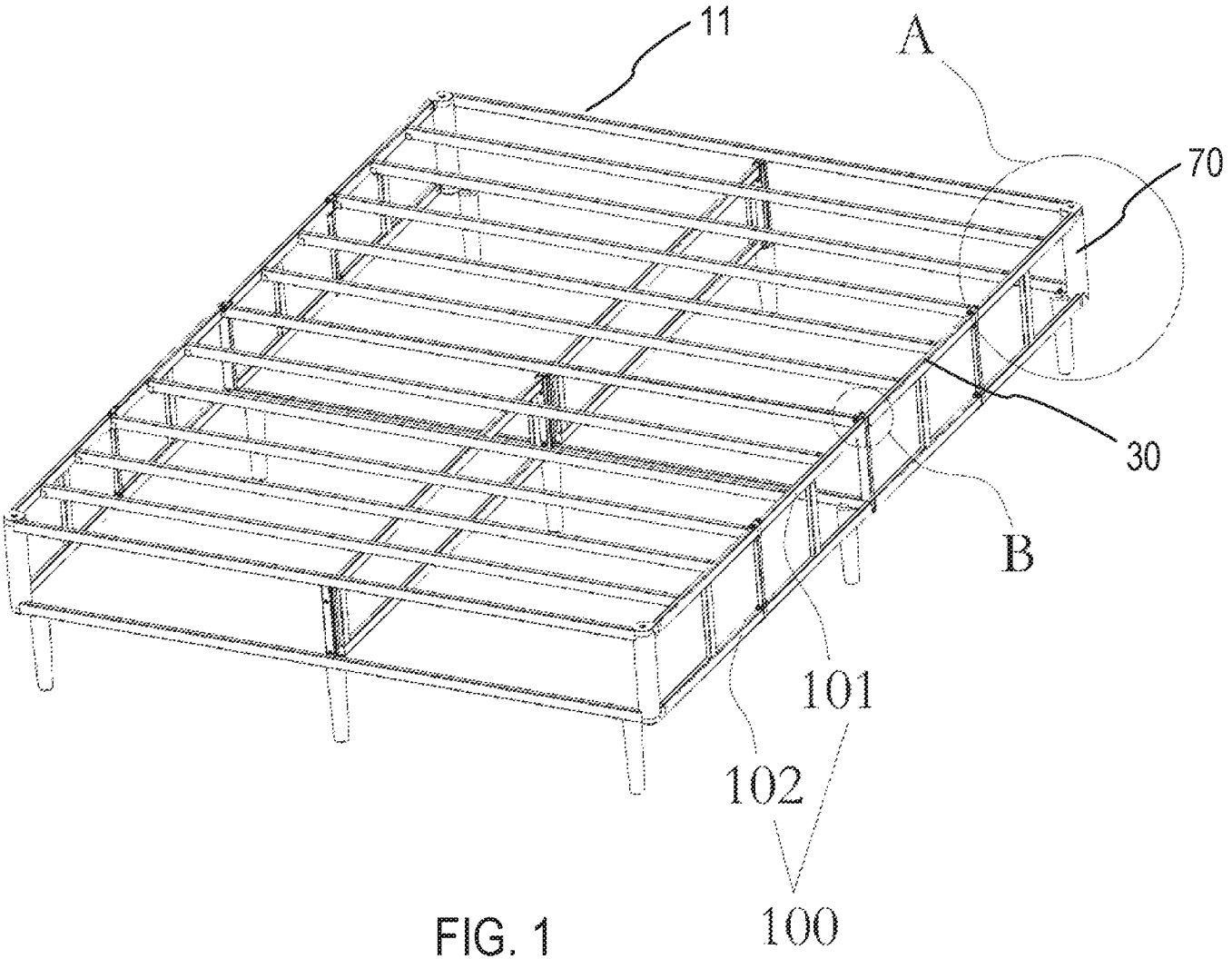
FIG. 1 is a perspective view illustrating an exemplary bed frame in an expanded state in accordance with exemplary embodiments of the present invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of collapsible bed frames and beds having one or more such collapsible bed frames. The collapsible beds and bed frames of the present invention can be of various sizes including but not limited to twin, full, queen and king sizes, and of various shapes including but not limited to rectangles and squares. They can be made of various materials including but not limited to metals (e.g., iron, steel, aluminum), plastics and woods.

In general, a collapsible bed frame of the present invention includes a plurality of lateral bar units, a plurality of first longitudinal bar units and a plurality of second longitudinal bar units. The plurality of lateral units is disposed in a lateral direction of the bed frame and arranged substantially parallel to each other. The plurality of first longitudinal bar units is disposed at a first side of the bed frame, and the plurality of second longitudinal bar units is disposed at a second side of the bed frame. Among the lateral and longitudinal bar units, adjacent bar units are rotatably connected with each other such that the bed frame of the present invention can contract and expand with no need to disconnect the lateral and longitudinal bar units.

Figure 3:
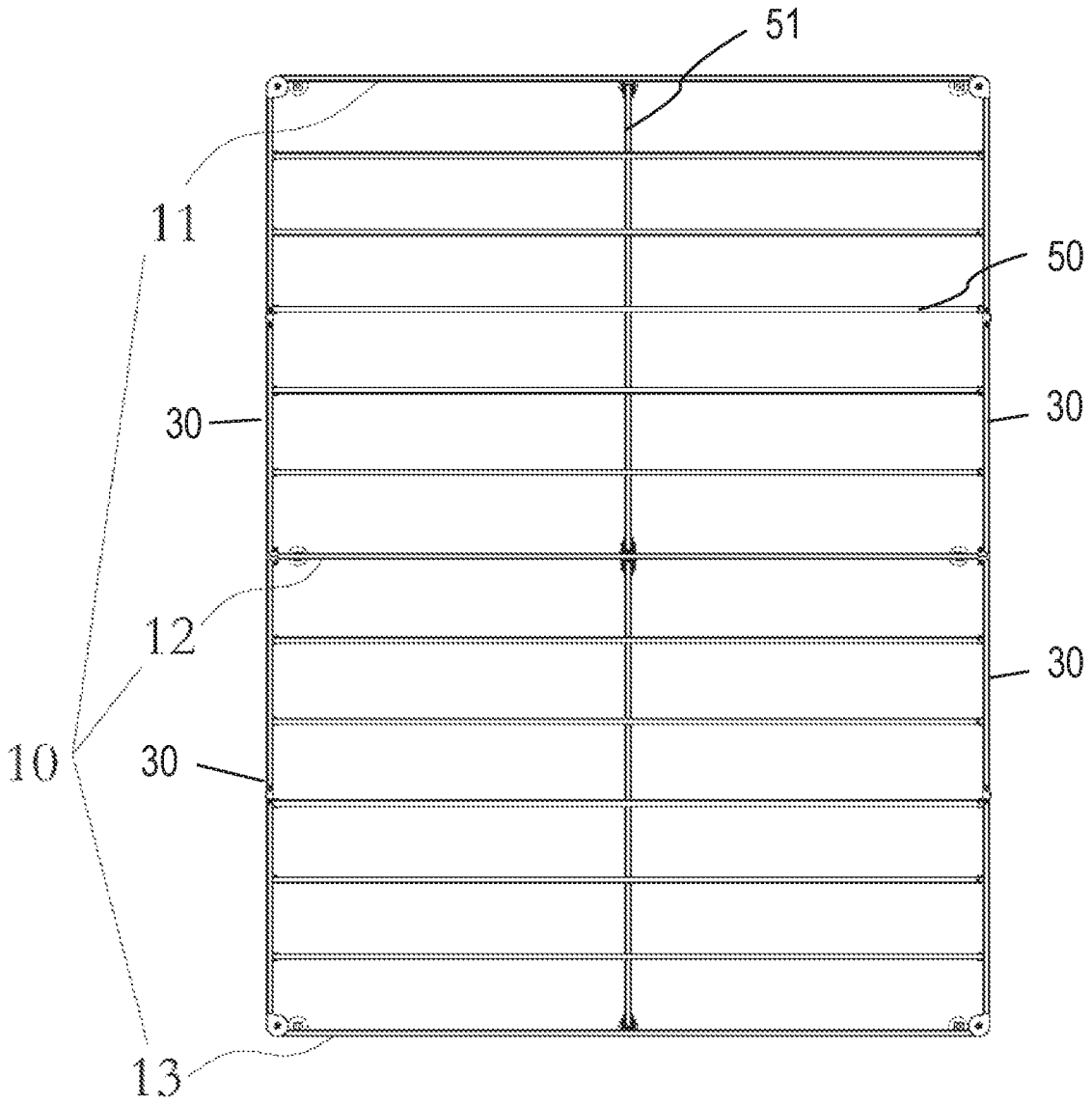
FIG. 3 is a top view illustrating an exemplary bed frame in an expanded state in accordance with exemplary embodiments of the present invention.
Figure 4:
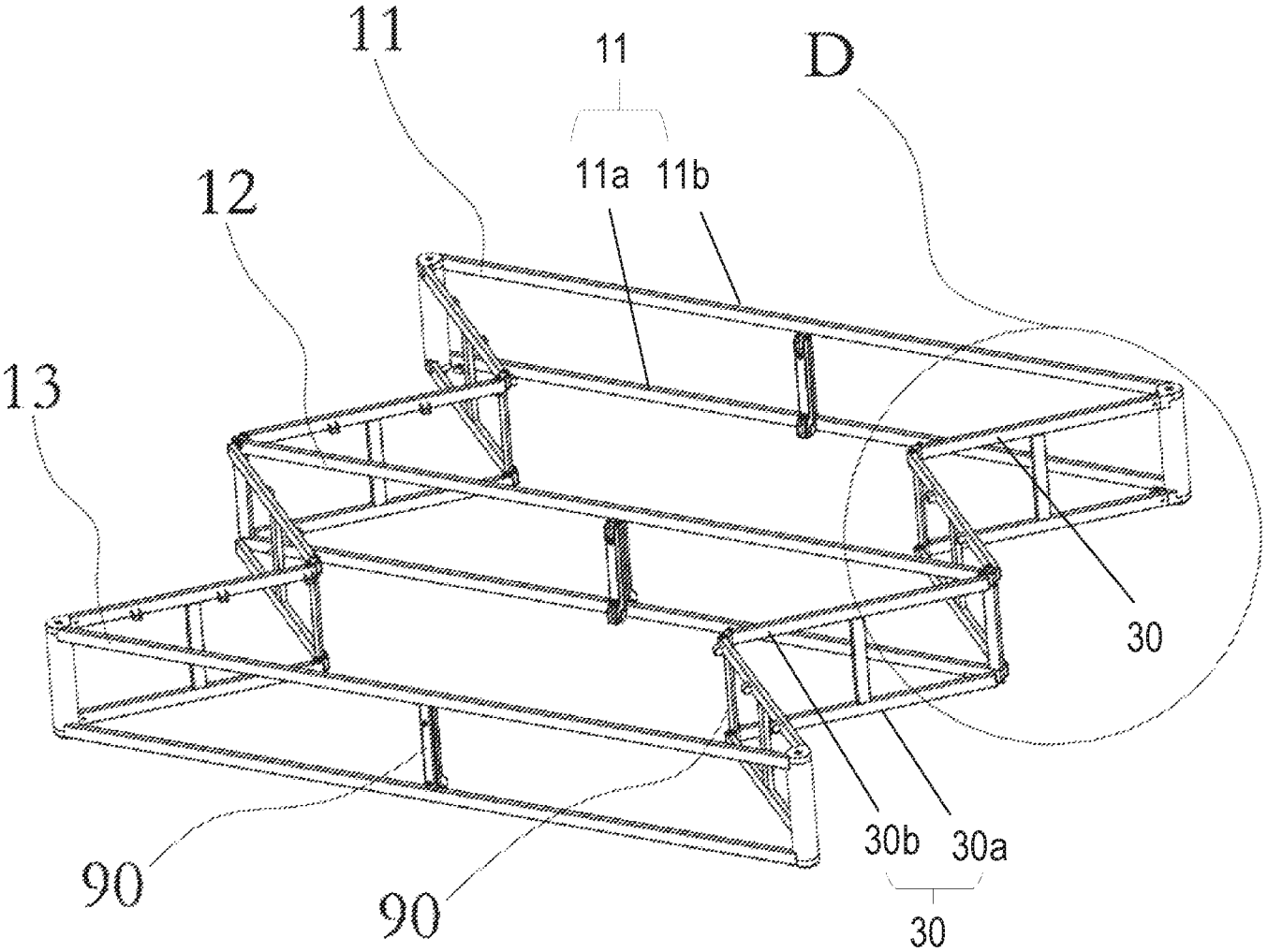
FIG. 4 is a perspective view illustrating an exemplary bed frame in an intermediate state in accordance with exemplary embodiments of the present invention.

In various exemplary embodiments, the plurality of lateral bar units includes a first outer lateral bar unit, a second outer lateral bar unit, and at least one inner lateral bar unit disposed between the first and second outer lateral bar units. In some exemplary embodiments, there is one single inner lateral bar unit, and in some other exemplary embodiments, there are two, three or more inner lateral bar units. By way of example, FIGS. 3 and 4 illustrate a collapsible bed frame including a plurality of lateral bar units indicated by reference numeral 10. The plurality of lateral bar units includes first outer lateral bar unit 11, second outer lateral bar unit 13, and inner lateral bar unit 12 disposed between first outer lateral bar unit 11 and second outer lateral bar unit 13.

Between each of two adjacent lateral bar units, a first longitudinal bar unit in the plurality of first longitudinal bar units is disposed at a first side of the collapsible bed frame and rotatably connected with the first ends of the two adjacent lateral bar units. Also, a second longitudinal bar unit in the plurality of second longitudinal bar units is disposed at a second side of the collapsible bed frame and rotatably connected with the second ends of the two adjacent lateral bar units. It should be noted that the first longitudinal bar unit can be the same as or different from the second longitudinal bar unit. It should also be noted that any two of first longitudinal bar units can be the same as or different from each other. Similarly, any two of second longitudinal bar units can be the same as or different from each other.

By way of example, FIGS. 3 and 4 illustrate a plurality of first longitudinal bar units disposed at a first side of the collapsible bed frame (e.g., left side in the figure), and a plurality of second longitudinal bar units disposed at a second side of the collapsible bed frame (e.g., right side in the figure). In the illustrated embodiment, two first longitudinal bar units 30 are disposed at the first side and two second longitudinal bar units 30 at the second side of the collapsible bed frame. One of the two first longitudinal bar units is disposed between first outer lateral bar unit 11 and inner lateral bar unit 12 and rotatably connected with the first ends (e.g., left ends) of the first outer lateral bar unit and inner lateral bar unit. The other of the two first longitudinal bar units is disposed between inner lateral bar unit 12 and second outer lateral bar unit 13 and rotatably connected with the first ends (e.g., left ends) of the inner lateral bar unit and second outer lateral bar unit. Similarly, one of the two second longitudinal bar units is disposed between first outer lateral bar unit 11 and inner lateral bar unit 12 and rotatably connected with the second ends (e.g., right ends) of the first outer lateral bar unit and inner lateral bar unit. The other of the two second longitudinal bar units is disposed between inner lateral bar unit 12 and second outer lateral bar unit 13 and rotatably connected with the second ends (e.g., right ends) of the inner lateral bar unit and second outer lateral bar unit.

Figure 10:
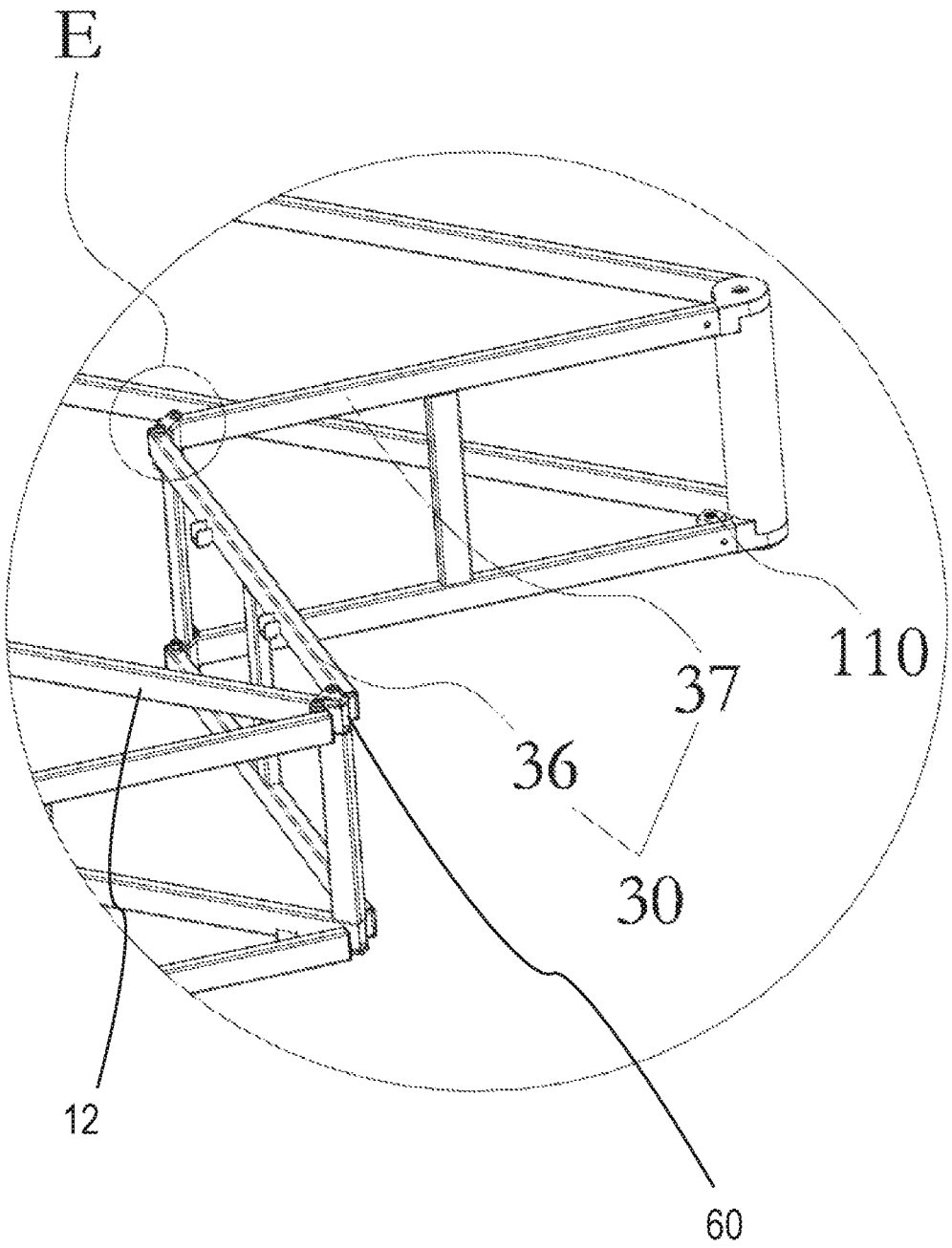
FIG. 10 is an enlarged view taken along circle D of FIG. 4.

In various exemplary embodiments, a longitudinal bar unit is made of two or more longitudinal segment units rotatably connected with each other. In some exemplary embodiments, each of the first and second longitudinal bar units is made of two or more longitudinal segment units rotatably connected with each other. It should be noted that the two or more longitudinal segment units can be the same as or different frame each other, for instance, having different lengths. By way of example, FIGS. 4 and 10 illustrate longitudinal bar unit 30 made of two longitudinal segment units, e.g., first longitudinal segment unit 36 and second longitudinal segment unit 37. The first and second longitudinal segment units are rotatably connected with each other at their proximal ends.

A lateral or longitudinal bar unit of the present invention can include a single bar or a stack of bars. As used herein, a stack of bars refers to two, three or more bars arranged one over another, e.g., in a vertical direction when the bed frame is expanded and placed on the ground. The two, three or more bars can be but not necessarily have to be in direct contact. For instance, a bar unit can include a lower bar, an upper bar above the lower bar, and/or vertical support(s) in between. By way of example, FIG. 4 illustrates first outer lateral bar unit 11 including lower lateral bar 11*a* and upper lateral bar 11*b*, and longitudinal bar unit 30 including lower longitudinal bar 30*a* and upper longitudinal bar 30*b*. In some exemplary embodiments, a lateral or longitudinal bar unit of the present invention includes one or more vertical supporting bars disposed between the upper and lower bars to support the upper bar. For instance, FIG. 4 illustrates one or more first vertical supporting bars 90 disposed between the lower and upper longitudinal bars to support the upper longitudinal bar, or between the lower and upper lateral bars to support the upper lateral bar. First vertical supporting bars 90 enhances the strength of the bed frame.

In various exemplary embodiments, the upper bars of the lateral bar units, first longitudinal bar units, and second longitudinal bar units collectively form an upper frame of the collapsible bed frame such as upper frame 101 illustrated in FIG. 1. Similar, the lower bars of the plurality of lateral bar units, first longitudinal bar units, and second longitudinal bar units collectively form a lower frame of the collapsible bed frame, such as lower frame 102 illustrated in FIG. 1. Together, the upper and lower frames are referred to as a frame unit such as frame unit 100. It should be noted that a frame unit can include of a single frame, or a stack of frames that includes two, three or more frames arranged one over another. Generally, a stack of frames is stronger than a single frame. A stack of frames also increases the height of the collapsible bed frame.

In various exemplary embodiments, receptacles are formed or disposed at some bar units. In some exemplary embodiments, at least one receptacle is formed or disposed at each bar unit in the plurality of lateral bar units, the plurality of first longitudinal bar units, and the plurality of second longitudinal bar units. Receptacles are configured to facilitate easy installation of lateral and/or longitudinal supporting bar units for supporting a mattress or the like, and to facilitate easy removal of the supporting bar units out before contracting the bed frame.

Figure 2:
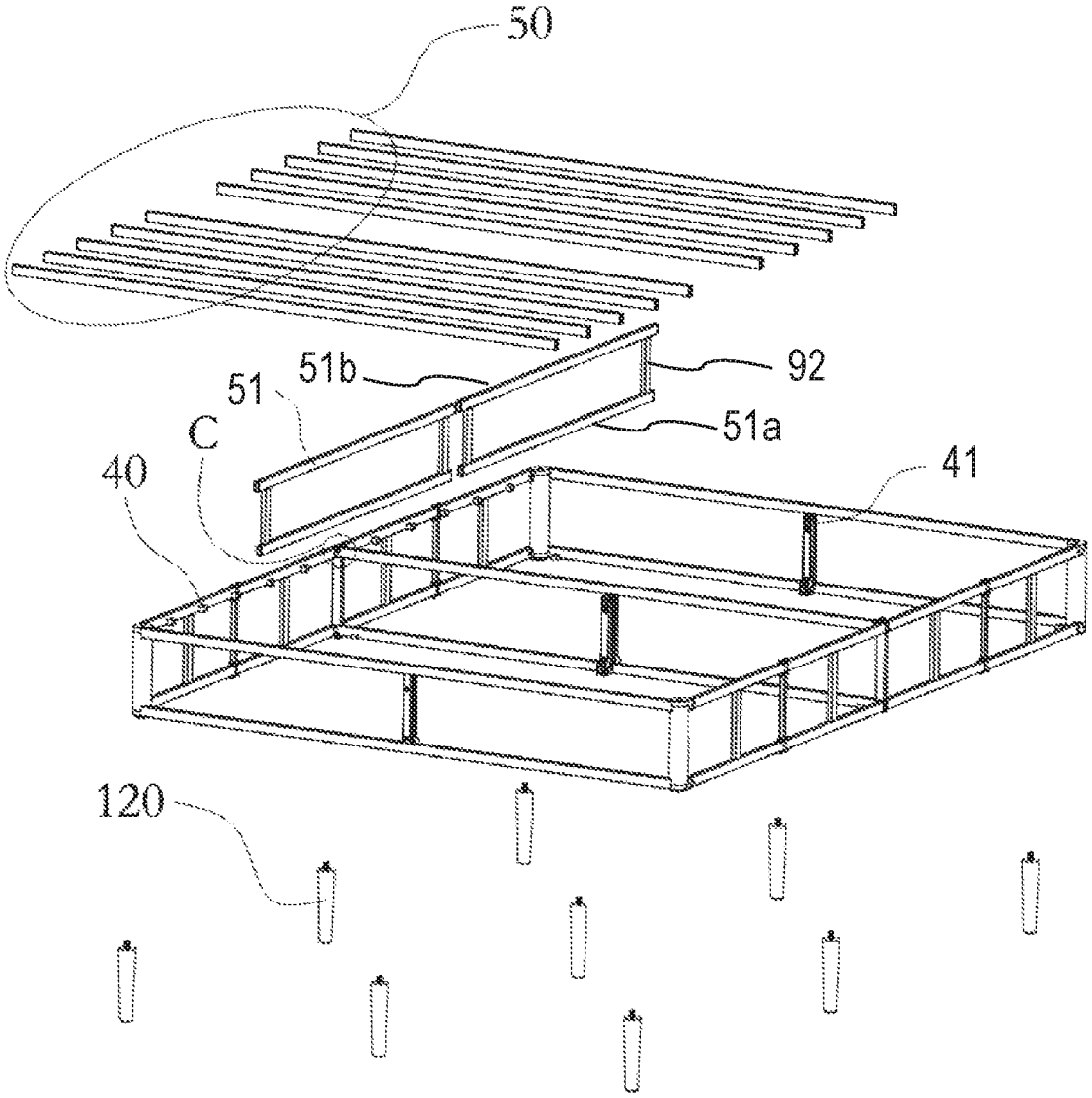
FIG. 2 is a disassembled perspective view illustrating an exemplary bed frame in accordance with exemplary embodiments of the present invention.

By way of example, FIG. 2 illustrates a plurality of receptacles 40 formed or disposed at longitudinal bar unit 30, and one or more receptacles 41 formed or disposed at an lateral bar unit such as first outer lateral bar unit 11. Receptacle 40 is configured to removably receive an end of lateral supporting bar unit 50 and receptacle 41 is configured to removably receive an end of longitudinal supporting bar unit 51 as illustrated in FIG. 2. In some exemplary embodiments, lateral supporting bar unit 50 is a single supporting bar.

Receptacle 40 and receptacle 41 can be substantially the same as or different from each other. In some exemplary embodiments, receptacle 40 is disposed at upper bar 30*b* of a longitudinal bar unit, and receptacle 41 is disposed at first vertical supporting bar 90 that is between the upper and lower bars of a lateral bar unit (e.g., first outer lateral bar 11). As such, longitudinal supporting unit 51 can be placed below lateral supporting bar unit 50. Lateral supporting bar unit 50 can be leveled with upper frame 101 and supported by longitudinal supporting unit 51. The resulted bed frame is more comfortable and more stable.

In some exemplary embodiments, a longitudinal supporting bar unit includes an upper longitudinal supporting bar and a lower longitudinal supporting bar. In some exemplary embodiments, a longitudinal supporting bar unit includes an upper longitudinal supporting bar, a lower longitudinal supporting bar, and one or more second supporting bars disposed between the upper and lower longitudinal supporting bars. For instance, by way of example, FIG. 2 illustrates longitudinal supporting bar unit 51 including upper longitudinal supporting bar 51*b*, lower longitudinal supporting bar 51*a*, and second vertical supporting bar 92 disposed between the upper and lower longitudinal supporting bars. In an exemplary embodiment, second vertical supporting bar 92 has an upper end connected with the upper longitudinal supporting bar and a lower end connected with the lower longitudinal supporting bar. In some exemplary embodiments, second receptacle 41 includes an upper receptacle to removably the end of upper longitudinal supporting bar 51*b* of longitudinal supporting bar unit 51, and a lower receptacle to removably the end of lower longitudinal supporting bar 51*a* of longitudinal supporting bar unit 51.

In various exemplary embodiments, a collapsible bed frame of the present invention includes a plurality of first connectors configured to connect the outer lateral bar units with the first and second longitudinal bar units. It should be noted that any two of the first connectors can be the same as or different from each other. In some exemplary embodiments, each first connector is configured to connect one end (e.g., the first or second end) of an outer lateral bar unit (e.g., first outer lateral bar unit 11 or second outer lateral bar unit 13) with one end of an adjacent longitudinal bar unit. In some exemplary embodiments, a first connector includes a body and a coupler rotatable with respect to the body. The body is connected or fixedly connected with the end of the outer lateral bar unit. The coupler is connected or fixedly connected with the end of the adjacent longitudinal bar unit.

Figure 6:
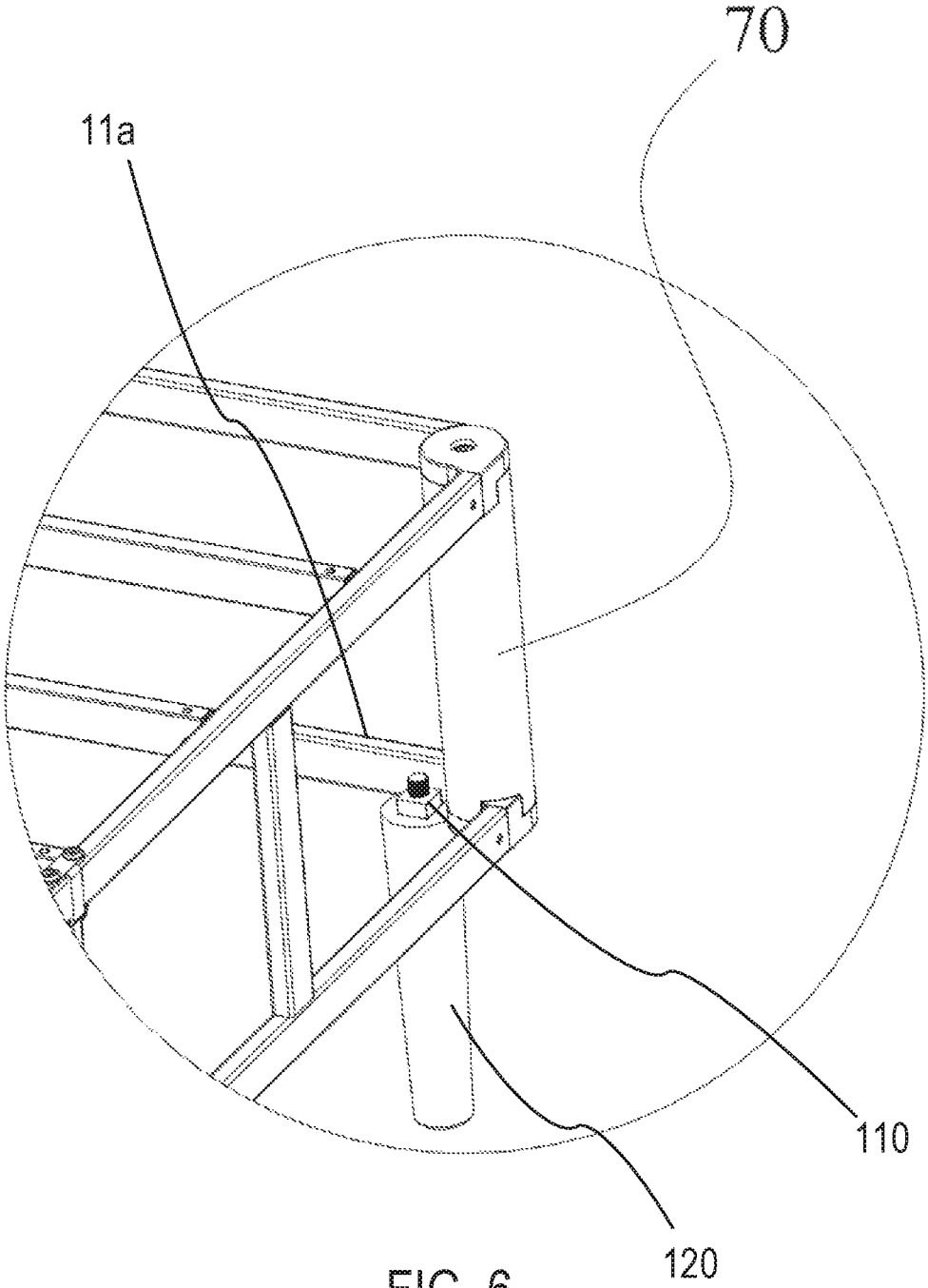
FIG. 6 is an enlarged view taken along circle A of FIG. 1.
Figure 7:
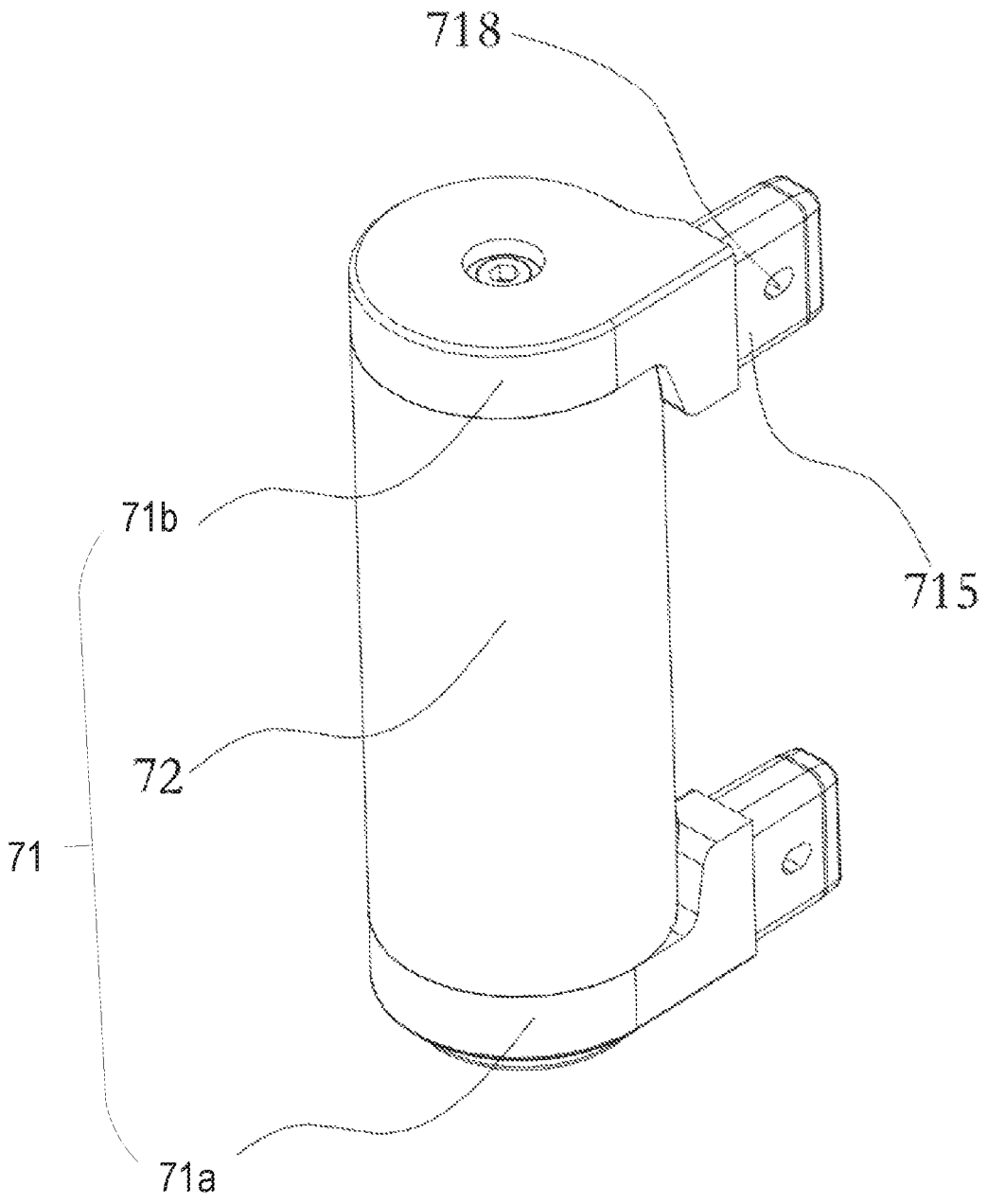
FIG. 7 is a perspective view illustrating an exemplary first connector in accordance with exemplary embodiments of the present invention.

By way of example, FIG. 1 illustrates a bed frame including first connector 70 to connect an end (e.g. the first or second end) of an outer lateral bar unit (e.g., the outer lateral bar unit 11 or second outer lateral bar unit 13) with an end of adjacent longitudinal bar unit 30. FIGS. 6 and 7 illustrate first connector 70 including first body 72 configured to connect or fixedly connect the end of the outer lateral bar unit (e.g., by welding, fastening or any other suitable means). In some exemplary embodiments, first body 72 has a substantially cylindrical shape.

First connector 70 also includes first coupler 71 disposed at first body 72 and rotatable with respect to first body 72. First coupler 71 is configured to connect or fixedly connect the end of adjacent longitudinal bar unit 30 (e.g., by welding, fastening or any other suitable means). First coupler 71 can be a single coupler or a stack of couplers. In some exemplary embodiments such as those where adjacent longitudinal bar unit 30 is a stack of bars that includes two or more bars, first coupler 71 itself can include two or more couplers, each for coupling with an end of one bar in the stack. By way of example, FIGS. 6 and 7 illustrate first coupler 71 including first lower coupler 71*a* and first upper coupler 71*b*. First lower coupler 71*a* is disposed at a lower portion of the first body and configured to couple with a lower longitudinal bar, e.g., lower longitudinal bar 30*a* of adjacent longitudinal bar unit 30. First upper coupler 71*b* is disposed at an upper portion of the first body and configured to couple with an upper longitudinal bar, e.g., upper longitudinal bar 30*b* of adjacent longitudinal bar unit 30. The first lower and upper couplers allow the lower and upper frames to contact and expand simultaneously.

In some exemplary embodiments, first coupler 71 includes a linking part configured to connect the end of adjacent longitudinal bar unit 30. By way of example, FIG. 7 illustrates each of first lower coupler 71*a* and first upper coupler 71*b* having linking part 715 formed with hole 718. One purpose of having linking part 715 is to ensure better connection with the end of adjacent longitudinal bar unit 30. In some exemplary embodiments, linking part 715 and the end of adjacent longitudinal bar unit 30 are configured to match with each other. Through hole 718, linking part 715 and the end of adjacent longitudinal bar unit 30 can be fastened by a fastener (e.g., a bolt). This results in a stronger and more stable connection.

In various exemplary embodiments, a collapsible bed frame of the present invention includes a plurality of second connectors configured to connect one or more inner lateral bar units with the first and second longitudinal bar units. It should be noted that any two of the second connectors can be the same as or different from each other. In various exemplary embodiments, each second connector is configured to connect one end (e.g., the first or second end) of an inner lateral bar unit (e.g., inner lateral bar unit 12) with ends of two first adjacent longitudinal bar units or with ends of two second adjacent longitudinal bar units. In some exemplary embodiments, each second connector is configured to connect one end of the inner lateral bar unit with the other ends of the first longitudinal segment units of two first longitudinal bar units or of two second longitudinal bar units.

Figure 8:
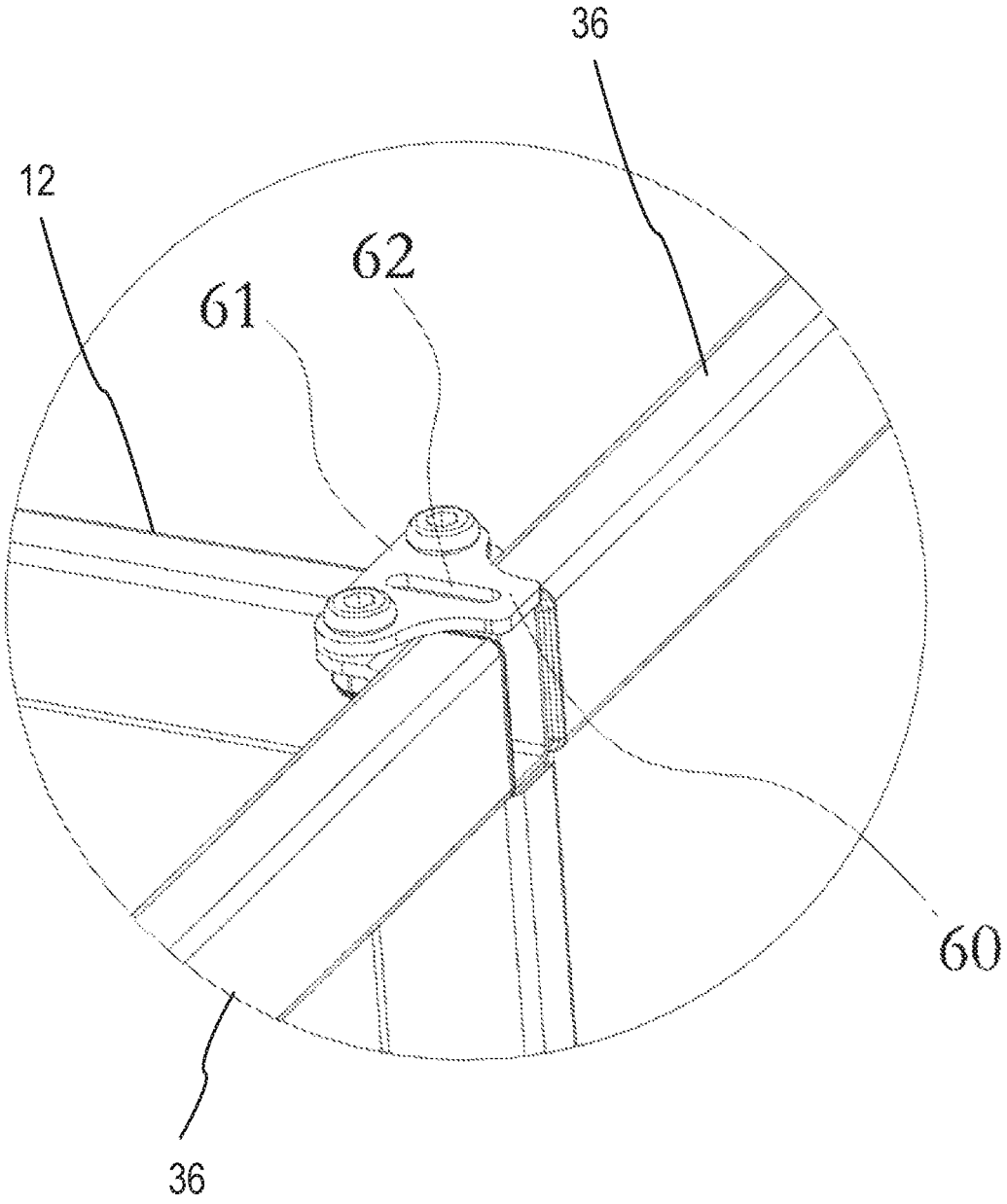
FIG. 8 is an enlarged view taken along circle B of FIG. 1.
Figure 9:
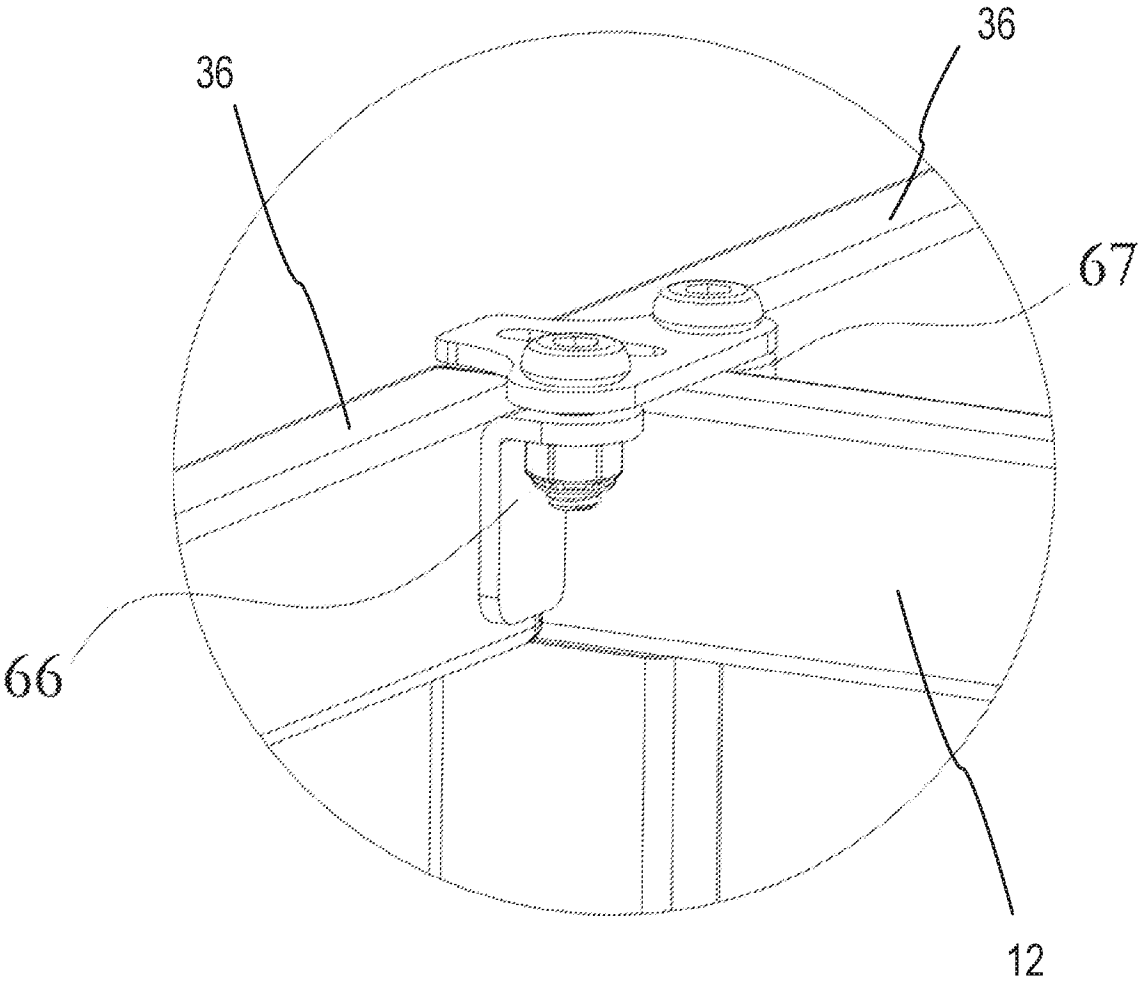
FIG. 9 is an enlarged view taken along circle C of FIG. 2.

A second connector generally includes a first piece, a second piece and a third piece. The second and third pieces are rotatably connected with the first piece. The first piece is configured to connect the first or second end of an inner lateral bar unit, and each of the second and third pieces is configured to connect a longitudinal bar unit. For instance, by way of example, FIGS. 8 and 9 illustrate second connector 60 including first piece 61, second piece 66 and third piece 67. First piece 61 is configured to connect the first or second end of inner lateral bar unit 12. In some exemplary embodiments, first piece 61 is configured to fixedly connect the first or second end of inner lateral bar unit 12, for instance, by welding or any other suitable means via through-hole 62 formed in first piece 61.

Second piece 66 is disposed at a first side of the first piece and third piece 67 is disposed at a second side of the first piece. Both of the second and third pieces are rotatably connected with the first piece, the connection of which can be by any suitable means including but not limited to bolts and nuts. Each of the second and third pieces is configured to connect an end of a longitudinal bar unit, such as an end of first longitudinal segment unit 36 of longitudinal bar unit 30. For instance, second piece 66 connects an end of first longitudinal segment unit 36 of longitudinal bar unit 30 that is disposed between inner lateral bar unit 12 and second outer lateral bar unit 13. Third piece 67 connects an end of first longitudinal segment unit 36 of longitudinal bar unit 30 that is disposed between inner lateral bar unit 12 and first outer lateral bar unit 11. In some exemplary embodiments, each of the second and third pieces is configured to fixedly connect an end of longitudinal bar unit 30, for instance, by welding or any other suitable means.

In some exemplary embodiments, the end of longitudinal bar unit 30 is disposed in the exterior side of the bed frame with respect to the second or third piece as illustrated in FIG. 9. This configuration allows first longitudinal segment unit 36 to rotate toward lateral bar unit 12 during contraction as illustrated in FIGS. 4 and 10.

It should be noted that second connector 60 can be a single connector or a stack of connectors. For instance, in some exemplary embodiments such as those where an inner lateral bar unit or adjacent longitudinal bar unit is a stack of bars, second connector 60 can be a stack of connectors (having two, three or more connectors) corresponding to the stack of bars.

Figure 11:
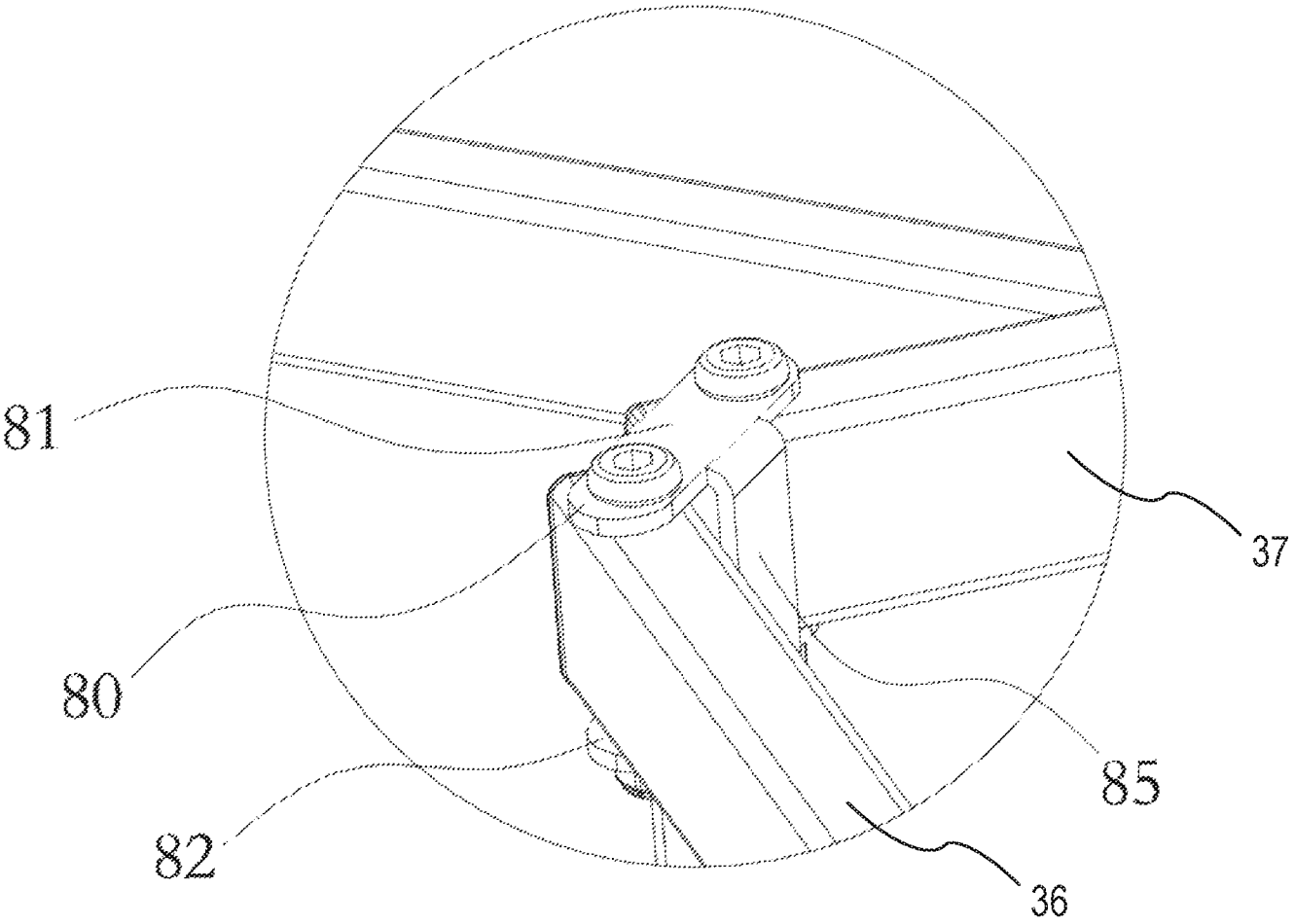
FIG. 11 is an enlarged view taken along circle E of FIG. 10.

In various exemplary embodiments, a collapsible bed frame of the present invention includes a plurality of third connectors, each configured to rotatably connect two adjacent longitudinal segment units, e.g., first longitudinal segment unit 36 and second longitudinal segment unit 37. For instance, by way of example, FIGS. 10 and 11 illustrate third connector 80 with first coupling piece 81 and second coupling piece 82. Ends of the first and second longitudinal segment units are disposed between the first and second coupling pieces and rotatably connected with the first and second coupling pieces, for instance, by bolts and nuts or any other suitable means. First longitudinal segment unit 36 is rotatable along a first axis, and second longitudinal segment unit 37 is rotatable along a second axis.

In some exemplary embodiments, third connector 80 includes a piece connecting the first and second coupling pieces. For instance, by way of example, FIG. 11 illustrates connecting piece 85 having one end connected with the first coupling piece and the other end connected with the second coupling piece. Collectively, the connecting piece and the first and second coupling pieces form a structure having a substantially "U"-shaped cross section.

The connecting piece is disposed at an exterior side of the bed frame when the bed frame is fully expanded. The connecting piece is shorter than the first and second coupling pieces in a longitudinal direction of the collapsible bed frame, and the first and second axes are located beyond the connecting piece in the longitudinal direction of the collapsible bed frame. Such configuration allows the first and second segment units to retreat, during contraction, into an interior space defined by the collapsible bed frame when it is fully expanded. In other words, during contraction, the proximal ends of the first and second longitudinal segment units of the first longitudinal bar unit and the proximal ends of the first and second longitudinal segment units of the second longitudinal bar unit move toward each other, or toward the longitudinal central plane of the bed frame, as illustrated in FIG. 4. In some exemplary embodiments, the connecting piece serves as a stopper to the first and second longitudinal bar units, and prevents them from rotating beyond the contracted state when the bed frame is contracted or beyond the expanded state when the bed frame is expanded or both.

It should be noted that third connector 80 can be a single connector or a stack of connectors. For instance, in some exemplary embodiments such as those where longitudinal bar units is a stack of bars, third connector 80 can be a stack of connectors (having two, three or more connectors) corresponding to the stack of bars.

In some exemplary embodiments, a collapsible bed frame of the present invention includes a plurality of legs and means to couple the legs with lower frame 102. For instance, by way of example, FIGS. 1 and 2 illustrate a plurality of legs 120 coupled with lower frame 102, in particular, the lower bar of lateral bar units 11, 12 and 13. FIGS. 6 and 10 illustrate coupler 110 disposed at lower bar 11*a* of first outer lateral bar unit 11. Coupler 110 is configured to couple leg 120, for instance, by screwing, bolting or any other suitable fastening means. The legs increase the height of the bed frame to suit different preferences of end users.

Figure 5:
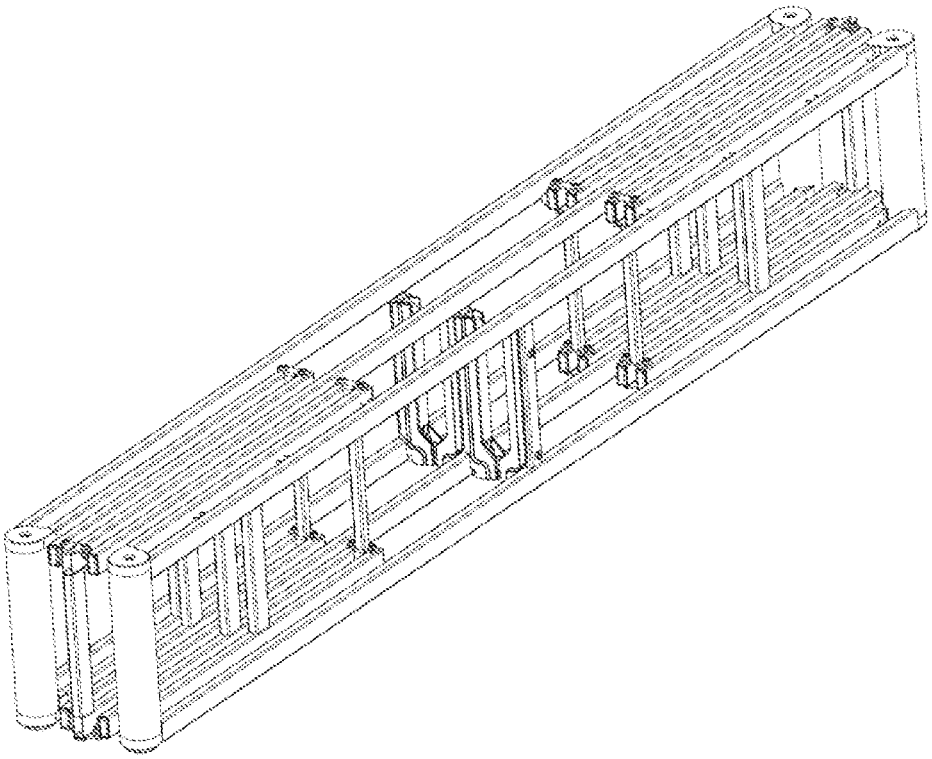
FIG. 5 is a perspective view illustrating an exemplary bed frame in a contracted state in accordance with exemplary embodiments of the present invention.

To contract the bed frame, remove the lateral and longitudinal bar units 50, 51 and legs 120 as illustrated in FIG. 2. Contract the bed frame so that first and second segment units 36 and 37 retreat into an interior space defined by the collapsible bed frame when it is fully expanded. In other words, allow the proximal ends of the first and second longitudinal segment units of the first longitudinal bar unit and the proximal ends of the first and second longitudinal segment units of the second longitudinal bar unit move toward each other, or toward the longitudinal central plane of the bed frame as illustrated in FIG. 4. Further contraction leads to the contracted state as illustrated in FIG. 5. Reverse this contraction process for expansion.

As disclosed herein, the collapsible bed frames of the present invention can contract and expand while the lateral and longitudinal bar units are connected with each other. As such, there is no need to assemble or disassemble these parts, and there is no need to carry tools such as screwdrivers and wrenches. Moreover, the sizes of the collapsible bed frames when contracted are reduced significantly. As such, they require less space for shipping, transportation and storage. Further, with the receptacles, the lateral and longitudinal supporting bar units can be easily installed or removed. As such, using a collapsible bed frame of the present invention to make a comfortable bed is not time consuming and does not require much effort.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first longitudinal bar unit could be termed a second longitudinal bar unit, and, similarly, a second longitudinal bar unit could be termed a first frame, without changing the meaning of the description, so long as all occurrences of the "first longitudinal bar unit" are renamed consistently and all occurrences of the "second longitudinal bar unit" are renamed consistently.

What is claimed is:

1. A collapsible bed frame comprising:

a plurality of lateral bar units, each arranged substantially parallel to another, each having a first end and a second end, wherein the plurality of lateral bar units comprises a first outer lateral bar unit and a second outer lateral bar unit; and a plurality of first longitudinal bar units disposed at a first side of the collapsible bed frame and coupled with the first ends of the first and second outer lateral bar units;

a plurality of second longitudinal bar units disposed at a second side of the collapsible bed frame and coupled with the second ends of the first and second outer lateral bar units; and a plurality of first connectors, each configured to couple a respective first or second end of the first or second outer lateral bar unit with a corresponding end of a first or second longitudinal bar unit in the plurality of first longitudinal bar units and the plurality of second longitudinal bar units;

wherein:

each bar unit in the plurality of lateral bar units, the plurality of first longitudinal bar units, and the plurality of second longitudinal bar units comprises an upper bar and a lower bar; and each first connector in the plurality of connectors comprises:

an elongated body having a central axis, an upper portion fixedly and inalterably coupled with the respective first or second end of the upper bar of the first or second outer lateral bar unit, and a lower portion fixedly and inalterably coupled with the respective first or second end of the lower bar of the first or second outer lateral bar unit;

an upper coupler disposed at the upper portion of the elongated body, rotatable around the central axis of the elongated body, and fixedly coupled with the corresponding end of the upper bar of the first or second longitudinal bar unit; and a lower coupler coupled disposed at the lower portion of the elongated body, rotatable around the central axis of the elongated body and fixedly coupled with the corresponding end of the lower bar of the first or second longitudinal bar unit, wherein the first or second outer lateral bar unit is different than the first or second longitudinal bar unit.

2. The collapsible bed frame of claim 1, further comprising:

a first longitudinal supporting unit and a second longitudinal supporting unit; and a plurality of vertical supporting bars comprising first, second, third and fourth vertical supporting bars;

wherein:

the plurality of lateral bar units further comprises an inner lateral bar unit disposed between the first and second outer lateral bar units;

each longitudinal bar unit in the plurality of first longitudinal bar units and in the plurality of second longitudinal bar units comprises a first longitudinal segment unit and a second longitudinal segment unit;

the first and second longitudinal segment units are rotatably connected with each other at one ends thereof;

the other end of the first longitudinal segment unit is rotatably connected with the first or second end of the inner lateral bar unit; and the other end of the second longitudinal segment unit is rotatably connected with the first or second end of the first or second outer lateral bar unit;

each bar unit in the plurality of lateral bar units, the plurality of first longitudinal bar units, and the plurality of second longitudinal bar units comprises an upper bar and a lower bar;

the upper bars of the plurality of lateral bar units, the plurality of first longitudinal bar units, and the plurality of second longitudinal bar units collectively form an upper frame of the collapsible bed frame;

the lower bars of the plurality of lateral bar units, the plurality of first longitudinal bar units, and the plurality of second longitudinal bar units collectively form a lower frame of the collapsible bed frame;

the first vertical supporting bar is disposed at the first outer lateral bar unit;

the second and third vertical supporting bars are disposed at the inner lateral bar unit;

the fourth vertical supporting bar is disposed at the second outer lateral bar;

each of the first, second, third and fourth vertical supporting bars comprises one or more receptacles configured to removably couple an end of the first or second longitudinal supporting unit; and the one or more receptacles of the first vertical supporting bar face the inner lateral bar unit, the one or more receptacles of the second vertical supporting bar face the first outer lateral bar unit, the one or more receptacles of the third vertical supporting bar face the second outer lateral bar unit, and the one or more receptacles of the fourth vertical supporting bar face the inner lateral bar unit, thereby allowing the first and second longitudinal supporting units to be coupled with or removed from the first, second, third and fourth vertical supporting bars while the plurality of first longitudinal bar units and the plurality of second longitudinal bar units are connected with the plurality of lateral bar units.

3. The collapsible bed frame of claim 2, further comprising:

a second connector at each of the first and second ends of the inner lateral bar unit, the second connector comprising:

a first piece formed with a through hole, and fixedly connected with the first or second end of the inner lateral bar unit;

a second piece rotatably connected with the first piece at a first side of the first piece, and fixedly connected with the other end of the first longitudinal segment unit of a longitudinal bar unit in the plurality of first or second longitudinal bar units; and a third piece rotatably connected with the first piece at a second side of the first piece, and fixedly connected with the other end of the first longitudinal segment unit of another longitudinal bar unit in the plurality of first or second longitudinal bar units.

4. The collapsible bed frame of claim 2, wherein the first and second longitudinal segment units are rotatably connected with each other at the one ends thereof by a substantially U-shaped connector.

5. The collapsible bed frame of claim 2, wherein the plurality of first vertical supporting bars is disposed between the upper and lower frames, each having an upper end connected with the upper frame and a lower end connected with the lower frame.

6. The collapsible bed frame of claim 2, further comprising a plurality of legs coupled with the lower bars of the plurality of lateral bar units.

7. The collapsible bed frame of claim 2, wherein the second and third vertical supporting bars disposed at the inner lateral bar unit are positioned back to back.

8. The collapsible bed frame of claim 2, wherein the second and third vertical supporting bars disposed at the inner lateral bar unit are individual and independent from each other.

9. The collapsible bed frame of claim 1, wherein the plurality of lateral bar units comprises an inner lateral bar unit disposed between the first and second outer lateral bar units;

wherein between the inner lateral bar and each respective outer lateral bar unit in the first and second outer lateral bar units, a first longitudinal bar unit in the plurality of first longitudinal bar units is disposed at a first side of the collapsible bed frame;

a second longitudinal bar unit in the plurality of second longitudinal bar units is disposed at a second side of the collapsible bed frame;

each of the first and second longitudinal bar units comprises a first longitudinal segment unit and a second longitudinal segment unit;

the first and second longitudinal segment units are rotatably connected with each other at one ends thereof;

the other end of the first longitudinal segment unit is rotatably connected with the first or second end of the inner lateral bar unit; and the other end of the second longitudinal segment unit is rotatably connected with the first or second end of the respective outer lateral bar unit;

wherein the one ends of the first and second longitudinal segment units of the first longitudinal bar unit and the one ends of the first and second longitudinal segment units of the second longitudinal bar unit move toward each other during contraction, and move away from each other during expansion.

10. The collapsible bed frame of claim 9, further comprising:

a second connector at each of the first and second ends of the inner lateral bar unit, the second connector comprising:

a first piece fixedly connected with the first or second end of the inner lateral bar unit;

a second piece rotatably connected with the first piece at a first side of the first piece, and fixedly connected with the other end of the first longitudinal segment unit of a longitudinal bar unit in the plurality of first or second longitudinal bar units; and a third piece rotatably connected with the first piece at a second side of the first piece, and fixedly connected with the other end of the first longitudinal segment unit of another longitudinal bar unit in the plurality of first or second longitudinal bar units.

11. The collapsible bed frame of claim 9, further comprising a plurality of third connectors, each third connector comprising a first coupling piece, a second coupling piece, and a connecting piece having one end connected with the first coupling piece and the other end connected with the second coupling piece, wherein:

the one end of the first longitudinal segment unit is disposed between the first and second coupling pieces, rotatably connected with the first and second coupling pieces, and rotatable along a first axis; and the one end of the second longitudinal segment unit is disposed between the first and second coupling pieces, rotatably connected with the first and second coupling pieces, and rotatable along a second axis.

12. The collapsible bed frame of claim 9, wherein:

the upper bars of the plurality of lateral bar units, the plurality of first longitudinal bar units, and the plurality of second longitudinal bar units collectively form an upper frame of the collapsible bed frame; and the lower bars of the plurality of lateral bar units, the plurality of first longitudinal bar units, and the plurality of second longitudinal bar units collectively form a lower frame of the collapsible bed frame.

13. The collapsible bed frame of claim 12, further comprising:

one or more first receptacles formed or disposed at the upper bars of the first and second longitudinal bar units, wherein each first receptacle is configured to removably receive an end of a lateral supporting bar unit.

14. The collapsible bed frame of claim 12, further comprising a plurality of first vertical supporting bars disposed between the upper and lower frames, each having an upper end connected with the upper frame and a lower end connected with the lower frame.

15. The collapsible bed frame of claim 14, further comprising one or more second receptacles disposed at one or more first vertical supporting bars that are disposed between the upper and lower bars of the lateral bar units, wherein each second receptacle in the one or more second receptacles is configured to removably receive an end of a longitudinal supporting bar unit.

16. The collapsible bed frame of claim 15, wherein:

the longitudinal supporting bar unit comprises an upper longitudinal supporting bar, a lower longitudinal supporting bar, and one or more second vertical supporting bars disposed between the upper and lower longitudinal supporting bars, each second vertical supporting bar having an upper end connected with the upper longitudinal supporting bar and a lower end connected with the lower longitudinal supporting bar.

17. The collapsible bed frame of claim 15, wherein each respective first receptacle in the one or more first receptacles is formed or disposed at an inner side of a corresponding upper bar in the upper bars of the first and second longitudinal bar units.

18. The collapsible bed frame of claim 15, wherein the one or more second receptacles are placed lower than the one or more first receptacles, thereby allowing the longitudinal supporting bar unit to be placed lower than the lateral supporting bar unit, and the lateral supporting bar unit to be leveled with the upper frame.

19. The collapsible bed frame of claim 12, further comprising a plurality of legs coupled with the lower bars of the plurality of lateral bar units.

* * * * *